United States Patent [19]

Hutchins et al.

[11] Patent Number: 4,869,326

[45] Date of Patent: Sep. 26, 1989

[54] BOX SCRAPER WITH PLURAL BLADES

[75] Inventors: David L. Hutchins, Rte. 5, Box 457; Lynn E. Mounce, Rte. 4, Box 667-H, both of Yadkinville, N.C. 27055

[73] Assignees: David L. Hutchins; Lynn E. Mounce, both of Yadkinville; John S. Martin, Hamptonville, all of N.C.

[21] Appl. No.: 257,979

[22] Filed: Oct. 14, 1988

[51] Int. Cl.[4] ..... A01B 49/02; E02F 3/76

[52] U.S. Cl. ..... 172/197; 172/445.1

[58] Field of Search ..... 172/445.1, 445.2, 197, 172/199, 684.5, 26.5, 26.6, 799.5; 37/117

[56] References Cited

U.S. PATENT DOCUMENTS

| | | | |
|---|---|---|---|
| 1,074,538 | 9/1913 | Alexander | 172/26.6 |
| 1,220,898 | 3/1917 | Smith | 172/684.5 |
| 2,433,019 | 12/1947 | Arps | 172/445.1 |
| 3,834,465 | 9/1974 | Collins | 172/197 |
| 4,044,843 | 8/1977 | Holub | 172/684.5 |
| 4,524,532 | 6/1985 | Browning | 172/197 |
| 4,655,297 | 4/1987 | Bourgeois | 172/445.1 |

*Primary Examiner*—Richard J. Johnson

*Attorney, Agent, or Firm*—Rhodes, Coats & Bennett

[57] ABSTRACT

A box blade attachment for tractors and like vehicles comprises a box frame which supports, for pivotal movement, a pair of moldboards, horizontally spaced from each other for scraping a surface in either a forward or backward path. Each of the moldboards moves independently of the other between a first position depending vertically between the sidewalls of the frame, and a second position pivoted inwardly and upwardly to lie in a plane substantially parallel to the surface being scraped. Hydraulic moldboard controls in the preferred embodiment synchronize the movement such that the moldboards move, alternatively and relative to each other, between the first and second positions. Thus arranged the box blade can be used in a conventional manner when the vehicle is moving in either direction by raising the appropriate moldboard and lowering the other.

12 Claims, 4 Drawing Sheets

FIG. 5
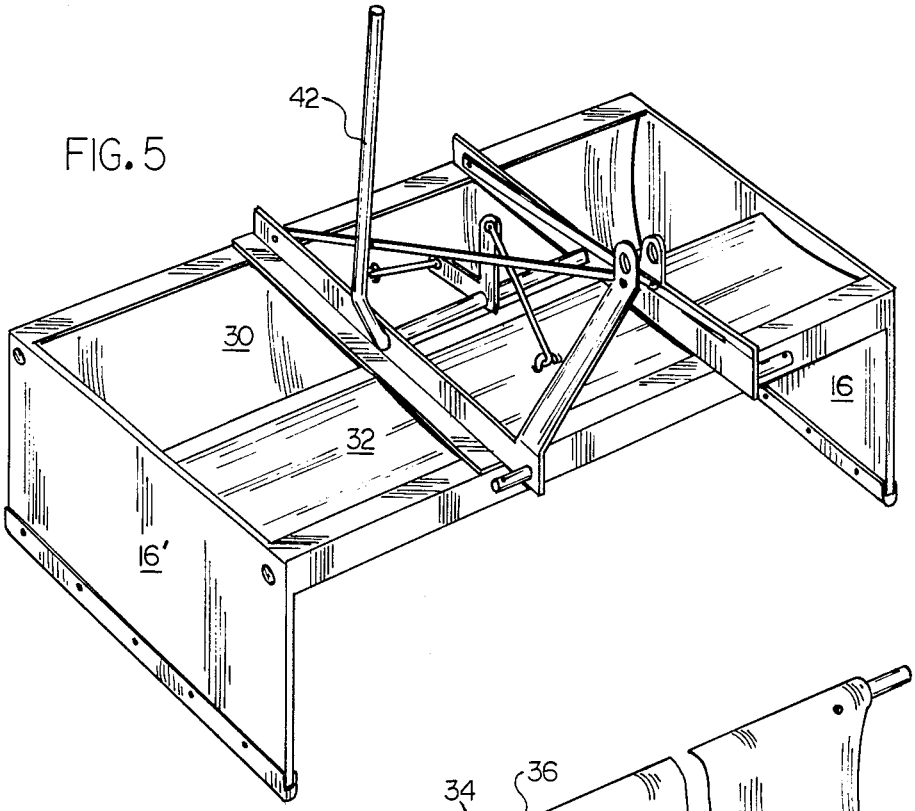
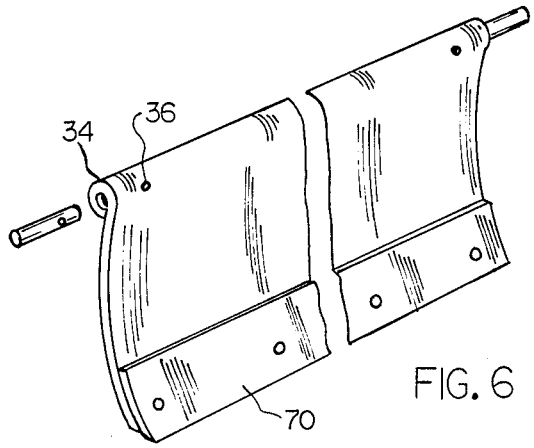
FIG. 6
FIG. 7
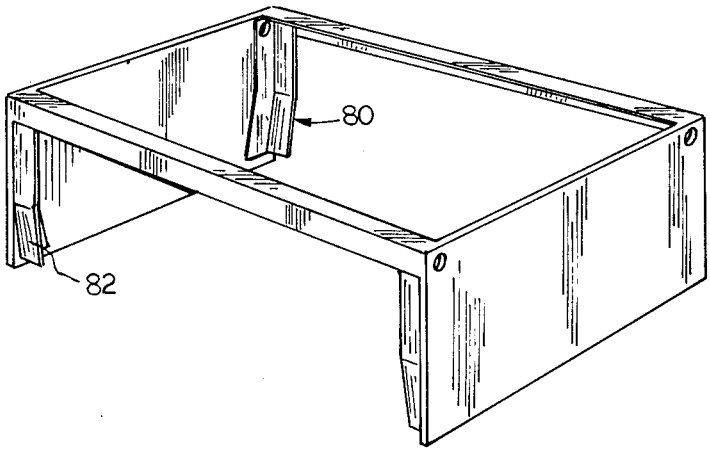

BOX SCRAPER WITH PLURAL BLADES

BACKGROUND OF THE INVENTION

The present invention is related to an attachment for vehicles such as tractors and other types of earth-moving, scraping or scooping equipment. It is particularly related to box blades which are used to scrape and move loose material on the surface of the ground from one area to another.

A problem with previously known box scrapers is related to the capability of the attachment to be used for scraping when moving in either a forward or rearward direction. Known scrapers, even those where the blade or moldboard is pivotally mounted are not designed to scrape in a bi-directional movement without turning the vehicle around. Although some box blades have pivotally mounted moldboards, none are designed such that the relative position of the moldboards are controlled so that the scraping action can be performed in any direction.

The first and second moldboards are pivotally mounted to the apparatus supporting frame and are movable between the first and second operative positions. In the first position the moldboard depends vertically between the side plates in a scraping position. In the second position the moldboards are pivoted inwardly (toward the intermediate area of the frame) and upwardly to a non-operative position substantially parallel to the surface being scraped. Control means operative, in a preferred embodiment, from the tractor positions one of the moldboards in the first position and the second moldboard in the second position according to the direction of movement. When the vehicle is reversed, not turned around, the relative positions of the moldboards are reversed.

A primary objective of the invention was to provide a box scraper that could perform a scraping function in either a forward or rearward path of movement.

Other and further objectives will become apparent as the following detailed description is studied in conjunction with the accompanying drawings. In the drawings:

FIG. 5 is a perspective view of the apparatus of FIGS. 1–4, plus an optional wear plate on the base of the side plates, taken from the side connected to the vehicle;

FIG. 6 is a perspective view with parts broken away of the frame and the moldboard stop means;

FIG. 7 is a perspective view of a moldboard removed from the supporting frame;

DETAILED DESCRIPTION OF A PREFERRED EMBODIMENT

Figure 1:
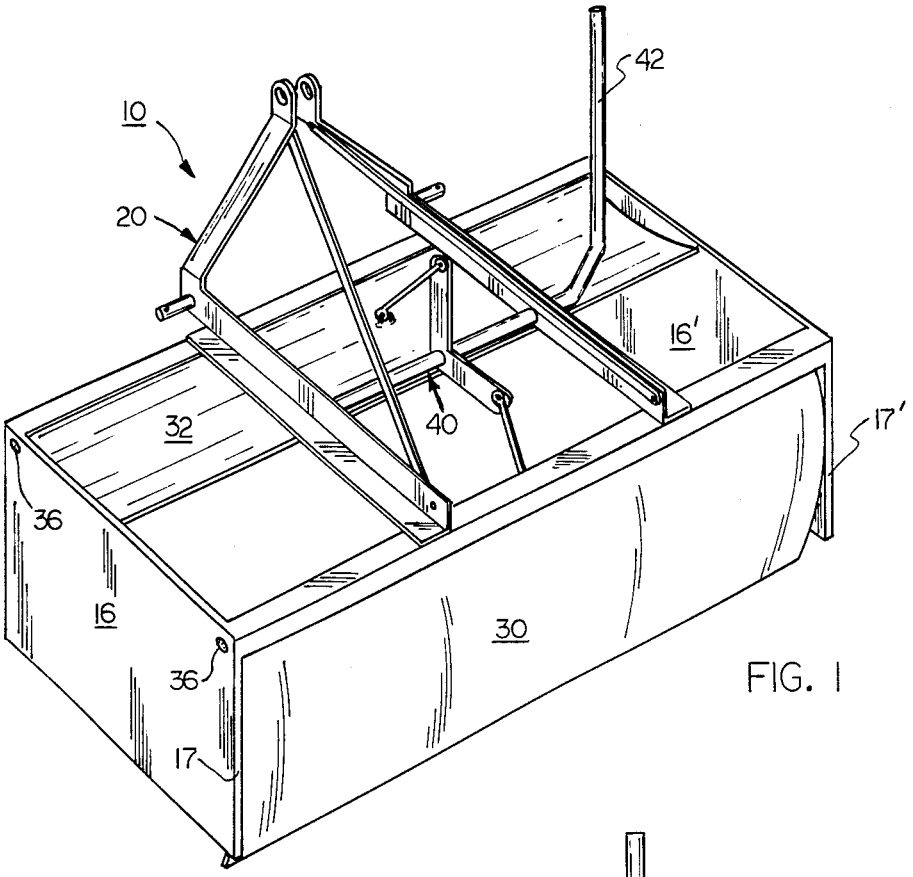
FIG. 1 is a perspective view of a preferred embodiment and would be attached to a selected vehicle.
Figure 3:
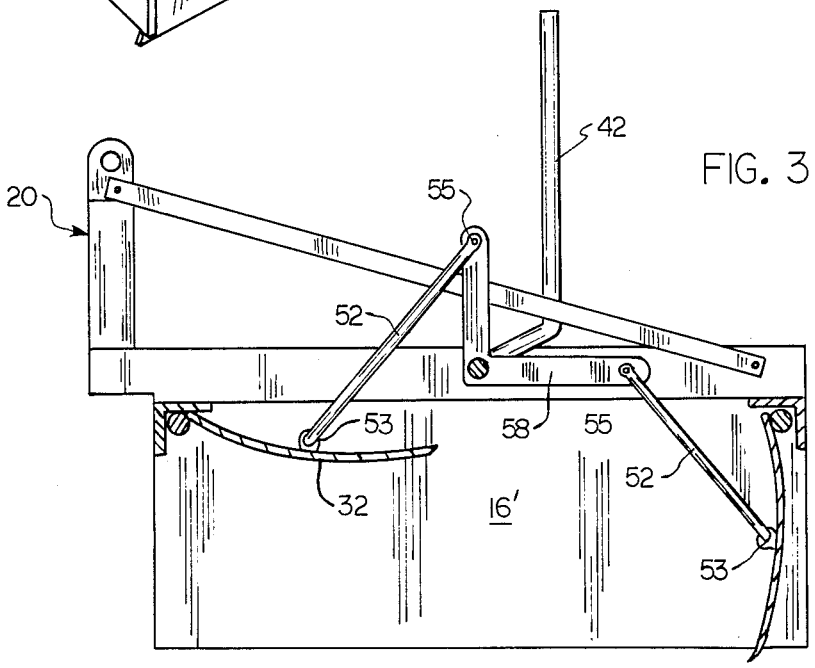
FIG. 3 is a side elevation of the apparatus of FIGS. 1 and 2.

Looking first at FIG. 1, a box scraper 10 is shown to include generally a supporting frame, a vehicle attachment mechanism 20, a first scraping blade moldboard 30 and a second moldboard 32 horizontally spaced from moldboard 30.

The supporting frame 15 is generally comprised of a pair of side plates 16 and 16' which are spaced apart a distance equivalent to the desired working/scraping width of the box scraper. Side plates 16,16' in the preferred embodiment are connected to each other by first and second elongated spacer bars 18,18'. In an alternate embodiment to be described below, the spacer bars are omitted and the moldboards are attached to the side plates by means of removable pins.

In the embodiment of FIG. 1, the moldboards 30,32 include along the upper edge thereof a tubular channel 34 through which an elongated mounting rod (not shown) is inserted. The rod extends into and is secured into apertures 36 in the upper corners of each side plate 16,16'.

The moldboards pivot on the tubular rod-type mounting between first and second positions. In FIG. 1, moldboard 30 is in the first position, depending downwardly between vertical edges 17,17' of the side plates; the first position is the scraping position. Under normal conditions, when one moldboard 30 or 32 is is the first position, the other of the moldboards (in FIG. 1, number 32) is in the second, non-operative position. This second position is retracted upwardly and inwardly toward the center of the apparatus, where it is held suspended in a plane substantially parallel to the planar surface of the area being scraped. Thus described the FIG. 1 illustration details the positioning of the moldboards when the vehicle is moving in reverse, and moldboard 30 is scraping in a backward direction, gathering the loose material within the framework.

Figure 2:
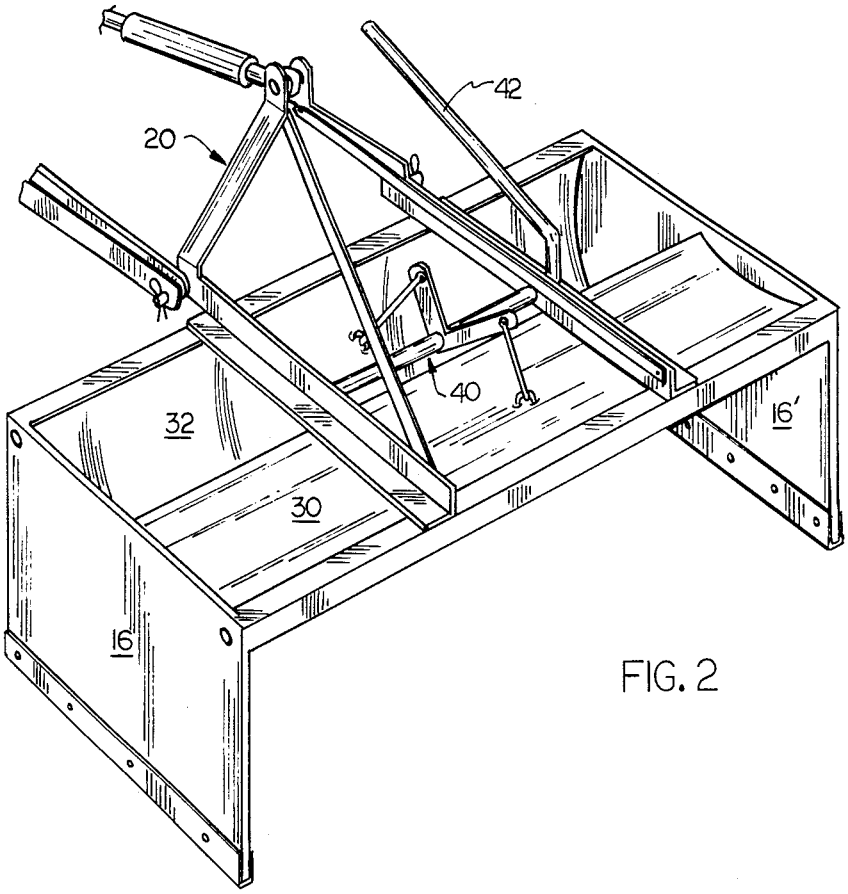
FIG. 2 is a perspective view of the embodiment of FIG. 1, with the moldboards in an alternate position.
Figure 4:
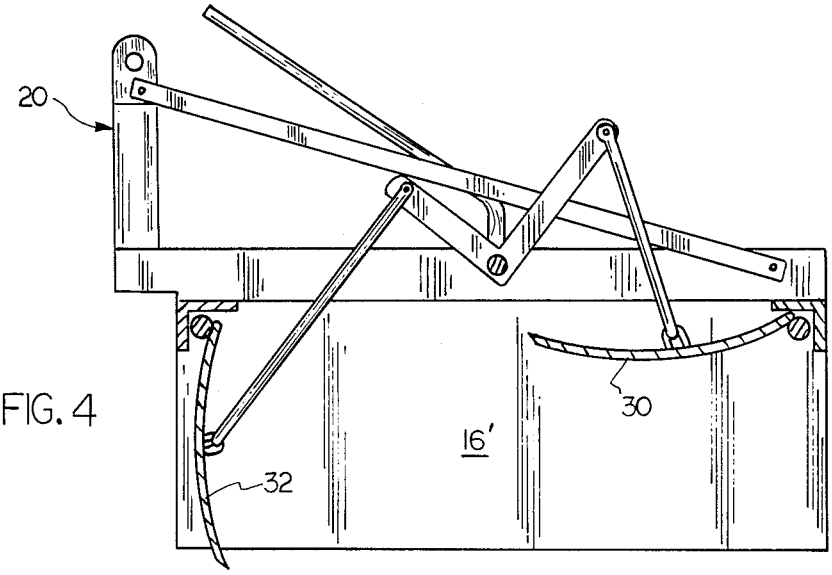
FIG. 4 is a side elevation of the apparatus of FIG. 3 with the moldboards in an alternate position.

In FIG. 2, the moldboards are in position such that moldboard 32 is scraping in a forward direction, the vehicle moving in a forward gear. By so designing the relative positions of boards 30,32, the function of the box scraper is substantially increased. It is not necessary to turn the vehicle around in order to push or pull the material being scraped. The vehicle gears are merely reversed. In confined areas, this function can make a critical difference in the time it takes to complete a job.

Relative movements of the moldboards is controlled by linkage means 40 which in the simplest embodiment is operated manually by lever 42 by the vehicle operator. In preferred embodiments the linkage means 40 is operatively connected to the hydraulic controls on the vehicle, for example at hydraulic cylinder 50. The linkage means itself is generally comprised of pivotally connected linkage blades 52 attached at 53 to the inner surface of moldboards 30,32; with the opposite blade ends attached at pivot points 55 to either end of a pivot arm 58. The L-shaped pivot arm 55 is operated by pushing or pulling lever 42 which is connected thereto by pivot rod 44. When the hydraulic controls are used, a connector arm 46 connects the hydraulic cylinder to the rod 44.

In some instances, it may be desirable to have both moldboards is a downward, first or scraping position. An additional hydraulic cylinder can be supplied in such environments to override the normal alternate positioning, thus enabling independent movement of the moldboards.

FIG. 5 illustrates the use of an optional wear plate on the ground engaging surface of each side plate 16,16' These replaceable, U-shaped wear plates are bolted or otherwise attached to the side plates to protect the surface thereof.

FIG. 6 illustrates the alternate moldboard attachment means wherein a pin is inserted through side plate apertures 36 and fastened into the end of tubular channel 34. Such pins can be quickly removed to change or repair moldboards.

In FIG. 7, there is also a wear plate 70 which is secured over the scraping edge of the moldboard. The wear plates are replaceable when worn, much less expensively than replacing the moldboard. The plates of FIGS. 5 and 7 may be of metal or hard polymeric materials.

Figure 8A:
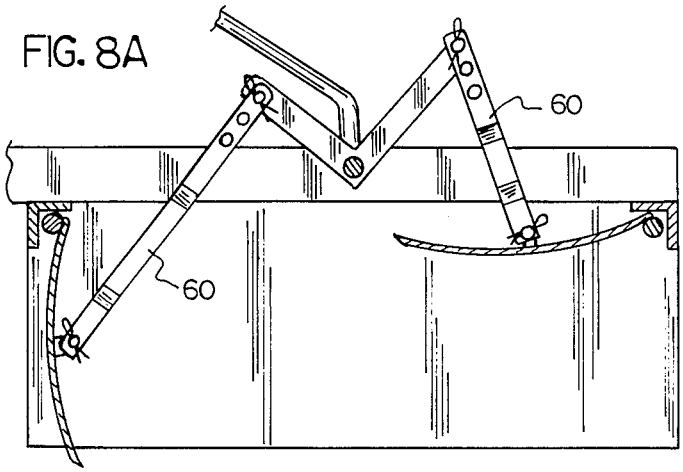
FIG. 8 (A–C) are detailed perspective views of alternate linkage means.
Figure 8B:
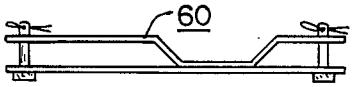
Figure 8C:
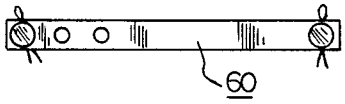

FIG. 7 also illustrates a stop means 80 which prevents the uninhibited backward swing of the moldboard. The stop means is generally comprised of an angle iron or flat blade-like device 82 bolted or welded on the side plate in the path of movement of the moldboard. If, however, the moldboards are caused to repeatedly strike against these stops, the linkage means 40 will begin to warp or bend, causing the moldboard to be out of alignment in the frame. Turnbuckle 90, attached to the yoke linkage of FIG. 8, permits the incremented adjustment or alignment of the linkage and moldboards to compensate therefor.

Figure 9:
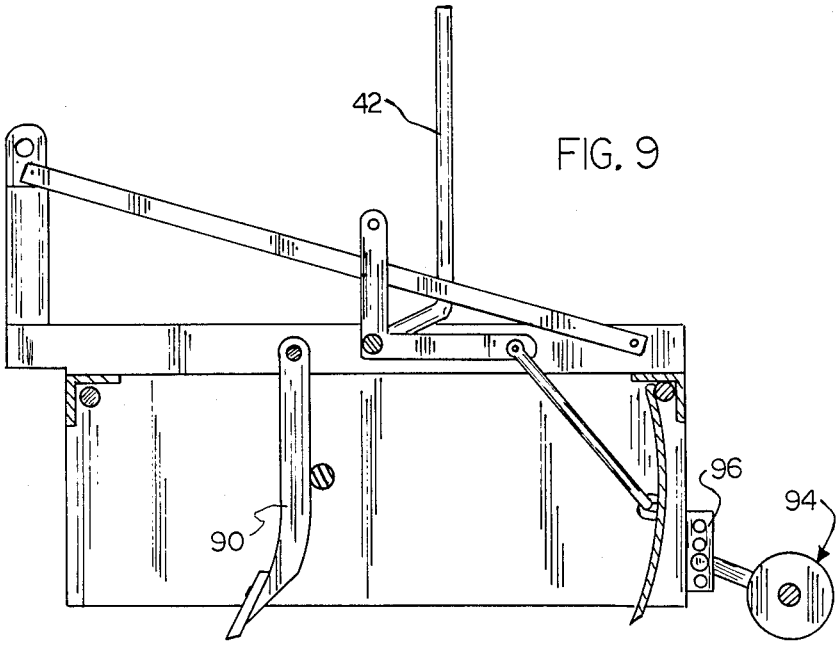
FIG. 9 is a side elevation of an alternate embodiment and use of the box scraper.

The final illustration in FIG. 9 is a modification of the box scraper wherein one moldboard 32,34 is removed and the other, in this instance 30, is moved to the aforedescribed second position. A detachable toothed blade 100 is pivotally mounted between side plates 16,16' and used to break up the surface over which it is driven. Where desired, a roller mechanism 94 follows blade 100 to smooth out the scraped surface. The effective vertical position of roller 94 may be adjusted by means of vertically spaced mounting apertures 96, which are in the bracket by which roller 94 is mounted to the box scraper.

While it is recognized that other and further modifications may be made to the described invention, such invention is limited only by the scope of the claims below:

We claim:

1. An improved box scraper for attachment to a tractor or like vehicular equipment; said box scraper comprising:

(a) pair of spaced side plates, each of said side plates having a prescribed height, an upper horizontal edge, a lower horizontal edge adapted to ride on the media being scraped, and opposed first and second vertical side edges;

(b) a first moldboard pivotally mounted between said side plates near the upper horizontal edge adjacent and substantially parallel to said first vertical side edges, and a second moldboard pivotally mounted between said side plates near the upper horizontal edge adjacent and substantially parallel to said second vertical side edges;

(c) said first and second moldboards each being movable, independently of and relative to each other, between a first position depending vertically between said side plates, and a second position pivoted inwardly and upwardly to a position wherein the moldboard lies in a plane substantially parallel to said upper edges of said side plates and the surface being scraped;

(d) moldboard control means for selectively controlling the movement of said moldboards between, the first and second positions;

(e) attachment means for securing said box scraper to said tractor.

2. An improved box scraper according to claim 1 and further including:

(a) linkage means for operably connecting said box scraper to the hydraulic controls on said tractor.

3. An improved box scraper according to claim 1 wherein said first and second moldboards move alternatively, relative to each other, between said first and second positions; whereby, when said first moldboard is in said first position, said second position moldboard is in said second position; and when said first moldboard is in said second position, said second moldboard is in said first position.

4. An improved box scraper according to claim 1 and further including a supporting frame having:

(a) first and second elongated spacer bars having a prescribed length determined by the selected width of said box scraper and utilized to support said first and second moldboards;

(b) said spacer bars being spaced apart a distance substantially equal to the distance between said first and second vertical edges of said side plates; and said spacer bars being attached to said side plates along the upper edges of said side plates;

(c) means for supporting said moldboard control means along the top edges of said spacer bars.

5. A box scraper according to claim 1 wherein said first and second moldboards each include a lower scraping edge; each of said lower scraping edges further including a wear plate removably attached thereto for protecting said scraping edges against wear.

6. A box scraper according to claim 2 and further including a stop means positioned along each of said vertical edges of said side plates for preventing overswing of said moldboards in a downward and rearward movement.

7. A box scraper according to claim 2 wherein said linkage means further includes a hydraulic control means for controlling said moldboards to move to a third position wherein both of said moldboards are simultaneously in said first position depending vertically between said side plates.

8. A box scraper according to claim 6 wherein said linkage means includes an adjustment means for adjusting incremently the positions of said moldboards to prevent bending of the moldboards due to striking against said stop means.

9. A box scraper according to claim 8 wherein said adjustment means comprises a turnbuckle operatively connected within said linkage means for adjusting said linkage means to alter the relative movement thereof.

10. An improved box scraper according to Claim 1 and further including:

(a) means for temporary removal of a selected one of said moldboards, and a means for displacement of the other of said moldboards to an inoperative position;

(b) a toothed blade for breaking up the surface being scraped; said toothed blade including means for detachably mounting to and being suspended between said side plates;

11. A box blade according to claim 10 further including a roller means mounted between said side plates in a position to follow said toothed blade and smooth the surface being broken up.

12. A box blade according to claim 11 including:

(a) means for detachably mounting said roller means to said side plates; and (b) means for adjusting the vertical position of said roller means relative to the surface being smoothed.

* * * * *